US006781922B2

(12) United States Patent
Ogasawara

(10) Patent No.: US 6,781,922 B2
(45) Date of Patent: Aug. 24, 2004

(54) ELECTRONIC TIMEPIECE

(75) Inventor: Kenji Ogasawara, Chiba (JP)

(73) Assignee: Seiko Instruments Inc., Chiba (JP)

( * ) Notice: Subject to any disclaimer, the term of this patent is extended or adjusted under 35 U.S.C. 154(b) by 107 days.

(21) Appl. No.: 10/124,357

(22) Filed: Apr. 16, 2002

(65) Prior Publication Data

US 2002/0159338 A1 Oct. 31, 2002

(30) Foreign Application Priority Data

Apr. 27, 2001 (JP) ..... 2001-132738

(51) Int. Cl.[7] ..... G04B 23/02; G04B 19/04; G04B 1/00; G04C 9/00

(52) U.S. Cl. ..... 368/73; 368/80; 368/187; 368/204

(58) Field of Search ..... 368/73, 76, 80, 368/155–157, 187, 204

(56) References Cited

U.S. PATENT DOCUMENTS 4,351,042 A * 9/1982 Ginalski et al. ..... 368/188
4,615,625 A * 10/1986 Moriya ..... 368/156
6,424,600 B1 * 7/2002 Okeya et al. ..... 368/204
6,542,440 B1 * 4/2003 Kihara ..... 368/204
6,643,223 B2 * 11/2003 Fujisawa ..... 368/204

* cited by examiner

*Primary Examiner*—Vit W. Miska
(74) *Attorney, Agent, or Firm*—Adams & Wilks

(57) ABSTRACT

To reduce power consumption by operating hands only when needed. By operating to depress a mode changeover switch, a second hand is moved selectively to a hand operation start time setting mode (WAKE) position, a hand operation stop time setting mode (SLEEP) and an alarm time setting mode (ALARM) position. Hand operation stop time, hand operation start time and alarm time are set by setting an hour/minute hand to desired time by operating to depress a time setting switch in a state in which the second hand is disposed at the respective setting mode positions. When the hand setting stop time arrives, operation of the time hands is stopped and when the hand operation start time arrives, the time hands are fed fast to regular time and thereafter, normal time indicating operation is carried out. When predetermined time period before alarm time is reached in a state in which hand operation is stopped, the time hands carry out operation similar to the above-described and are recovered to normal operation and thereafter alarm is generated when the alarm time arrives.

8 Claims, 9 Drawing Sheets

ELECTRONIC TIMEPIECE

BACKGROUND OF THE INVENTION

1. Field of the Invention

The present invention relates to an electronic timepiece for driving to rotate a time hand based on rotation of a motor.

2. Description of the Prior Art

Conventionally, there has been used an electronic timepiece for indicating time by driving to rotate a time hand of an hour hand or the like by a motor. The motor is driven by a battery and therefore, power consumption by the motor is preferably as less as possible.

Conventionally, an electronic timepiece using a primary battery is designed to use a battery having a capacity satisfying prescribed service life based on current for operating the electronic timepiece and therefore, there is not provided a power saving function for reducing power consumption.

Meanwhile, as in an electronic timepiece described in Japanese Patent Laid-Open No. 304555/1997 or Japanese Patent Laid-Open No. 319143/1998, according to a power generating timepiece using a secondary battery chargeable by a power generating element of a solar cell or the like, when there is detected a state of being incapable of generating power such as a state of not receiving light, a motor for driving a hand is made to stop driving to rotate, that is, operation of the hand is made to stop. Thereby, when the power generating element cannot generate power, a reduction in power consumption can be achieved.

Meanwhile, generally, a user rarely uses a timepiece in a way of confirming time by taking a look at the timepiece around the clock.

For example, there is a time band of not taking a look at a timepiece as in the case of sleeping or the like. Further, according to an electronic wrist watch, there is a time band of not taking a look at the timepiece by taking off the timepiece from the wrist as in the case of sleeping or taking a bath. Further, there also is a way of using a timepiece in which the timepiece is ordinarily kept in a drawer and is used as needed and in that case, the timepiece may be kept in the drawer for days without taking a look at the timepiece.

Even in such a case of not taking a look at a timepiece, since a hand is operated in the timepiece, there poses a problem that power is wastefully consumed.

It is a problem of the invention to reduce power consumption by operating a hand of a timepiece only when needed.

SUMMARY OF THE INVENTION

According to the invention, there is provided an electronic timepiece characterized in comprising a motor for driving to rotate a time hand, time setting means for setting hand operation stop time and hand operation start time of the time hand, storing means for storing the hand operation stop time and the hand operation start time set by the hand operation time setting means, first counting means for counting a drive amount necessary for driving the time hand to a regular position by counting an elapse time period since the motor has been stopped, second counting means for counting a drive amount of fast feeding the motor, time detecting means for detecting arrival of time set to the storing means, and controlling means for controlling rotation of the motor, wherein the controlling means stops the rotation of the motor when the time detecting means detects arrival of the hand operation stop time and restarts time indication by fast feeding the motor at a predetermined speed or more until the drive amount counted by the first counting means and the drive amount counted by the second counting means coincide with each other when the time detecting means detects arrival of the hand operation start time after stopping the motor and driving the motor at the predetermined speed.

When the time detecting means detects arrival of the hand operation stop time, the controlling means stops rotation of the motor and when the time detecting means detects arrival of the hand operation start time after stopping the motor, the controlling means restarts time indication by fast feeding the motor at the predetermined speed or more until the drive amount counted by the first counting means and the drive amount counted by the second counting means coincide with each other and thereafter driving the motor at the predetermined speed.

Here, there may be constructed a constitution further comprising hand operation stopping means for forcibly stopping to operate the time hand and hand operation stop detecting means for detecting operation of the hand operation stopping means, wherein the controlling means stops the rotation of the motor when the hand operation stop detecting means detects the operation of the hand operation stopping means.

Further, there may be constructed a constitution further comprising hand operation starting means for forcibly starting to operate the time hand and hand operation start detecting means for detecting operation of the hand operation starting means, wherein the controlling means restarts the time indication by fast feeding the motor at the predetermined speed or more until the drive amount counted by the first counting means and the drive amount counted by the second counting means coincide with each other when the hand operation start detecting means detects the operation of the hand operation starting means after stopping the motor and thereafter driving the motor at the predetermined speed.

Further, there may be constructed a constitution further comprising alarming means for setting alarm time to the storing means and generating alarm when the alarm time arrives at the time setting means, wherein the controlling means restarts the time indication by fast feeding the motor at the predetermined speed or more until the drive amount counted by the first counting means and the drive amount counted by the second counting means coincide with each other when the time detecting means detects a predetermined time period before the alarm time after stopping the motor and thereafter driving the motor at the predetermined speed.

Further, there may be construction a constitution in which the timepiece is constituted by an hour hand, a minute hand and a second hand and the motor is constituted by a first motor for driving the second hand and a second motor for driving the hour hand and the minute hand.

Further, there may be constructed a constitution further comprising mode switching means for switching a hand operation stop time setting mode for setting the hand operation stop time and a hand operation start time setting mode for setting the hand operation start time and hand operation time setting means for setting the hand operation stop time by the hand operation stop time setting mode and setting the hand operation start time by the hand operation start time setting mode at the time setting means, wherein the controlling means controls the first motor to move the second hand selectively to indicating positions of the hand operation stop time setting mode and the hand operation start time setting mode in response to mode switching by the mode switching means.

Further, there may be constructed a constitution in which the mode switching means switches the mode further to an alarm time setting mode for setting alarm time and the hand operation time setting means sets the alarm time by the alarm time setting mode, wherein the controlling means moves the second hand selectively to indicating positions of the hand operation stop time setting mode, the hand operation start time setting mode and the alarm time setting mode in response to the mode switching by the mode switching means.

Further, there may be constructed a constitution further comprising crown operation detecting means for detecting operation of a crown at the mode switching means for carrying out the mode switching in accordance with the operation of the crown detected by the crown operation detecting means.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

A detailed explanation will be given of embodiments of the invention in reference to the drawings as follows.

Figure 1:
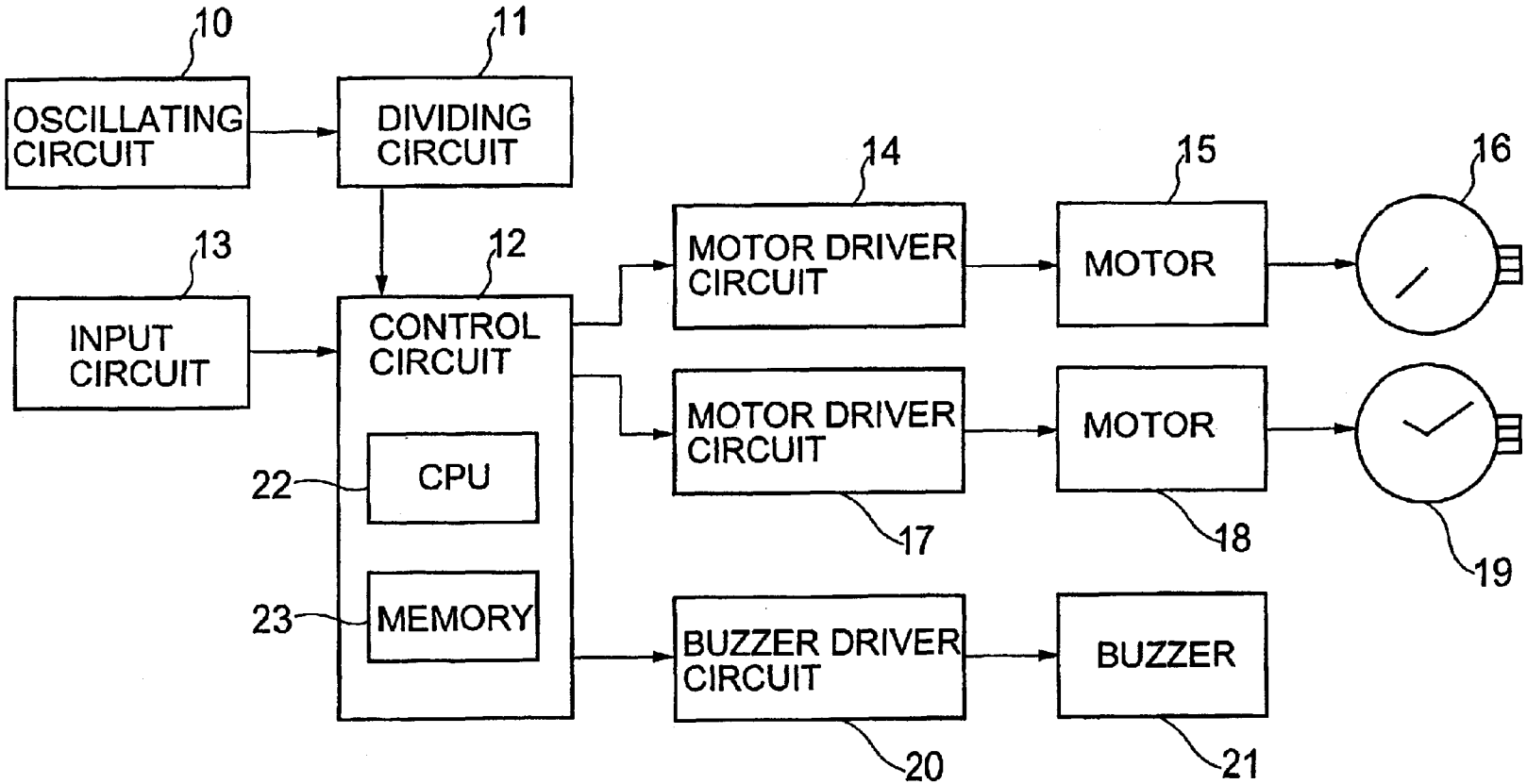
FIG. 1 is a block diagram of an electronic timepiece according to an embodiment of the invention.

FIG. 1 is a block diagram of an electronic timepiece according to an embodiment of the invention and is a block diagram of an electronic timepiece commonly used in respective embodiments, mentioned later.

In FIG. 1, an oscillating circuit 10 generates a clock signal of a predetermined frequency (for example, 32768 Hz) and outputs the clock signal to a dividing circuit 11. The dividing circuit 11 generates timepiece signals (for example, a second signal of 1 Hz for driving to rotate a second hand 16, a minute signal of ⅕ Hz for driving to rotate an hour/minute hand 19) and a fast feed signal of 32 Hz for fast feeding the second hand 16 and the hour/minute hand 19 by dividing the clock signal and outputs the signals to a control circuit 12.

The control circuit 12 is provided with a central processing unit (CPU) 22 and a memory 23 constituting storing means. The memory 23 is stored with a processing program for controlling operation of the time hands and is set and stored with hand operation stop time for stopping operation of the time hands, operation start time for starting operation of the hands and alarm time for generating alarm. As described later, CPU 22 carries out processings of controlling to drive the time hands 16 and 19 by controlling rotation of a motor 15 for driving the second hand as a first motor and a motor 18 for driving the hour/minute hand as a second motor and carries out various processings of an alarm generating processing and the like by executing the above-described program stored to the memory 23. The motors 15 and 18 are step motors generally used for a timepiece.

Further, as described later, CPU 22 constitutes hand stop operation detecting means, hand start operation detecting means, and mode switching means for switching a hand operation stop time setting mode, a hand operation start time setting mode and an alarm time setting mode, constitutes controlling means for controlling to rotate the motors 15 and 18 along with motor driver circuits 14 and 17 and constitutes alarming means along with a buzzer driver circuit 20 and a buzzer 21.

Further, CPU constitutes first counting means for counting a drive amount necessary for driving to move the time hands 16 and 19 to regular positions by counting an elapse time period since the motors 15 and 18 have been stopped, second counting means for counting a drive amount of fast feeding the motors 16 and 19 and time detecting means for detecting arrival of time set to the memory 23. Further, when CPU functions as the first counting means, every time of counting a drive amount by which the second hand 16 is rotated by 60 seconds from a stop position, a count value of the drive amount is reset and the drive amount is newly counted. Further, every time of counting the drive amount by which the time/minute hand 19 is rotated for 12 hours from a stop position, a count value of the drive amount is reset and the drive amount is counted newly.

An input portion of the control circuit 12 is connected with an input circuit 13 for setting the hand operation stop time, the hand operation start time and the alarm time. Further, the input circuit 13 includes a detection switch (not illustrated) for detecting operation of a crown 13.

As described later, the input circuit 13 constitutes time setting means for setting the hand operation stop time, the hand operation start time and the alarm time of the time hands 16 and 19, hand operation stopping means for forcibly stopping operation of the time hands 16 and 19, hand operation starting means for forcibly starting operation of the time hands, mode switching means for switching the hand operation stop time setting mode, the hand operation start time setting mode and the alarm time setting mode and time setting means for setting the hand operation stop time, the hand operation start time and the alarm time.

An output portion of the control circuit 12 is connected with the motor 15 for driving the second hand via the motor driver circuit 14 for driving the second hand and is connected with the motor 18 for driving the hour/minute hand via the motor driver circuit 17 for driving the hour/second hand. The motor 15 drives the second hand 16 in response to a drive signal from the motor driver circuit 14 and the motor 18 drives the hour hand and the minute hand 19 in response to a drive signal from the motor driver circuit 17.

Further, an output portion of the control circuit 12 is connected with the buzzer 21 via the buzzer driver circuit 20.

Figure 2:
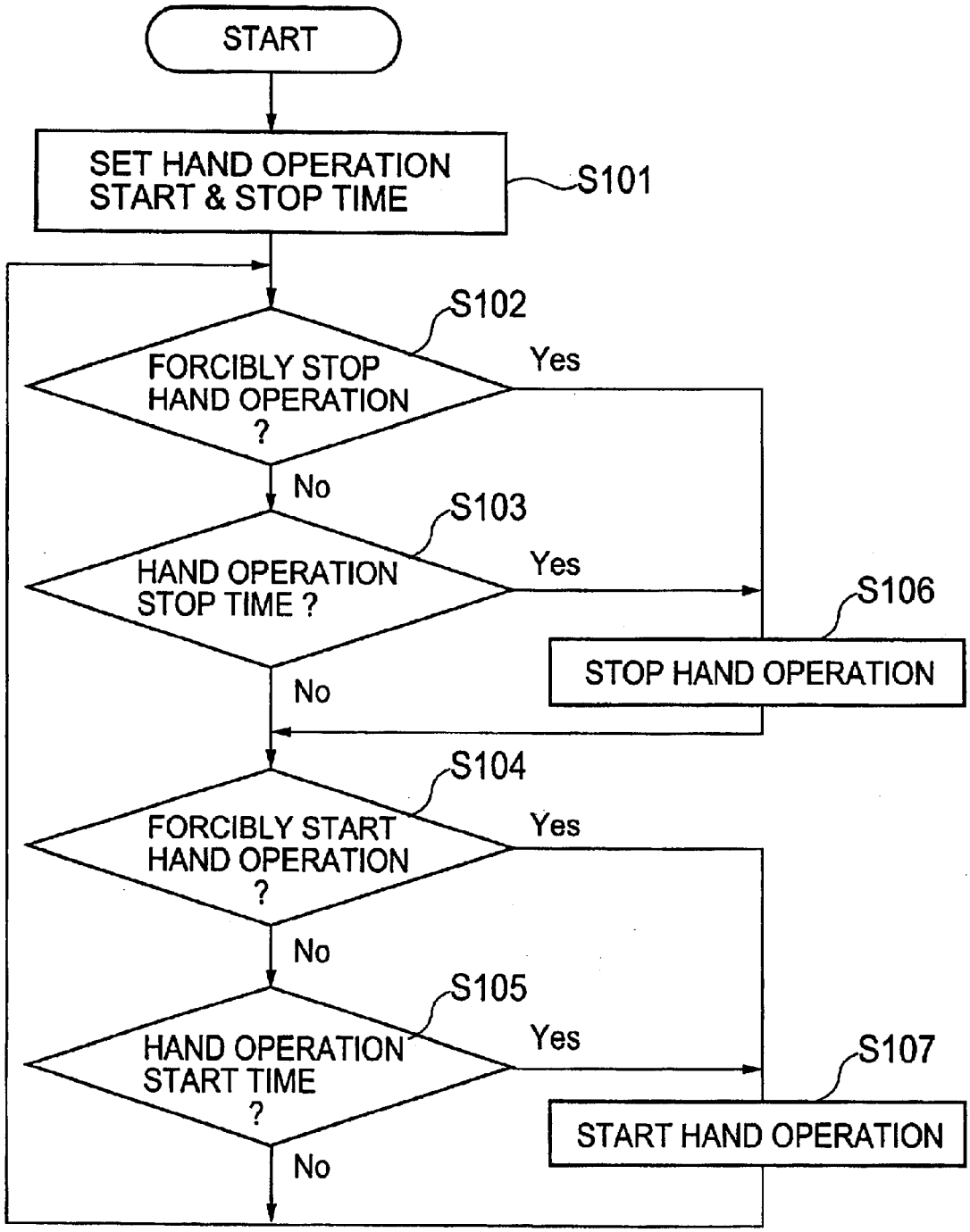
FIG. 2 is a flowchart showing a processing of a first embodiment of the invention.

FIG. 2 is a flowchart showing processings of CPU 22 according to a first embodiment of the invention and is a flowchart showing basic operation except an alarm processing. An explanation will be given of operation of the first embodiment according to the invention in reference to FIG. 1 and FIG. 2 as follows.

First, by operating time setting means (not illustrated), from the input circuit 13, there are set hand operation stop time for stopping to operate the second hand 16 and the hour/minute hand 19 as well as hand operation start time for starting to operate the second hand 16 and the time/minute hand 19 (step S101 of FIG. 2). The memory 23 is stored with the hand operation stop time and the hand operation start time of the time hands 16 and 19.

Under the state, it is determined whether hand operation stopping means (not illustrated) is operated, that is, whether forcible stop instruction is inputted from the input circuit 13 (step S102), when it is determined that the forcible stop instruction is inputted, the control circuit 12 processes to stop operation of the time hands 16 and 19 and outputs a hand operation stop signal to the motor driver circuits 14 and 17 (step S106). The motor driver circuits 14 and 17 respectively stop rotating the motors 15 and 18 in response to the hand operation stop signal to thereby stop operation of the time hands 16 and 19.

When it is determined that the hand operation stopping means is not operated, that is, the forcible stop instruction is not inputted from the input circuit 13, it is determined whether the hand operation stop time stored to the memory 23 has arrived (step S103) and when it is determined that the hand operation stop time has arrived, the hand operation stop processing is carried out and the hand operation stop signal is outputted to the motor driver circuits 14 and 17 (step S106). The motor driver circuits 14 and 17 stop rotating the motors 15 and 18 in response to the hand operation stop signal to thereby stop operation of the time hands 16 and 19.

When it is determined that the hand operation stop time has not arrived at step S103, it is determined whether hand operation starting means (not illustrated) is operated, that is, whether forcible hand operation start instruction is inputted from the input circuit 13 (step S104) and when it is determined that the forcible hand operation start instruction is inputted from the input circuit 13, a hand operation start processing is carried out (step S107).

In the hand operation start processing at step S107, the control circuit 12 outputs a fast feed signal generated by the dividing circuit 11 to the motor driver circuits 14 and 17. At the time point, the first counting means has already counted the drive mount (drive pulse number) for driving the time hands 16 and 19 to regular positions by counting an elapse time period since the motors 15 and 18 have been stopped and the second counting means counts the drive amount (drive pulse number) for fast feeding the motors 16 and 19 by the fast feed signals and the motors fast fed at predetermined feeds or more until the drive amount counted by the first counting means and the drive amount counted by the second counting means, coincide with each other (until current time). Thereafter, time indication is restarted by driving the motors 15 and 18 at the predetermined speeds by a second signal and a minute signal generated by the dividing circuit 11. Thereby, after restarting to operate the time hands 16 and 19, the current time is indicated fastly, thereafter, the hands are driven to rotate at the predetermined speeds by ordinary hand operation control and time is indicated accurately.

At step S104, when it is determined that the forcible hand operation start instruction is not inputted from the input circuit 103, it is determined whether the hand operation start time stored to the memory 23 has arrived (step S105) and when it is determined that the hand operation start time has arrived, the hand operation start processing is carried out (step S107).

Meanwhile, at step S105, when it is determined that the hand operation start time has not arrived, the operation returns to step S102 and the above-described processings are repeated.

Further, step S101 constitutes hand operation time setting means, step S102 constitutes hand operation stop detecting means, S104 constitutes hand operation start detecting means and steps S103 and S105 constitute time detecting means.

As described above, the hands are operated only when needed and therefore, in driving the second hand 16 to current time by driving to rotate the motor 15 at step S107, an amount of driving to rotate the second hand 16 becomes less than 60 seconds at maximum and an amount of driving to rotate the hour/minute hand 19 becomes less than 12 hours at maximum and therefore, power consumption can considerably be reduced. Further, in the case of driving to feed fast the second hand 16 and the hour/minute hand 19, when the hands are driven to rotate in directions in which the hands reach current time faster, power consumption can further be reduced.

Figure 3:
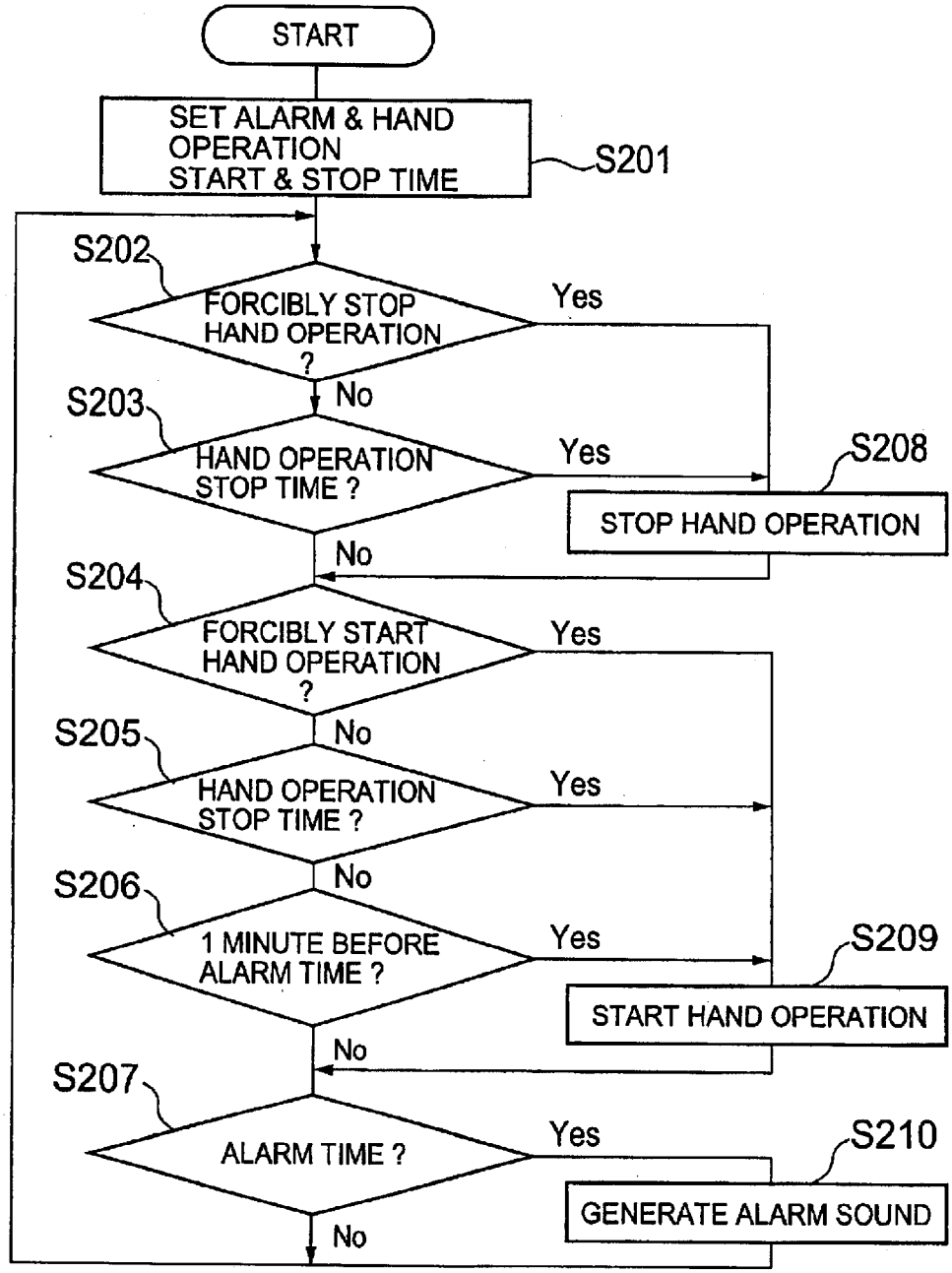
FIG. 3 is a flowchart showing a processing of a second embodiment of the invention.

FIG. 3 is a flowchart showing processings of CPU 22 according to a second embodiment of the invention and is a flow chart showing basic operation including the alarm processing.

Although according to the first embodiment, there is constructed a constitution in which only the hand operation stop time and the hand operation start time of the time hands 16 and 19 are set, according to the second embodiment, not only the hand operation stop time and the hand operation start time of the time hands 16 and 19 are set but also alarm time is set and the time hands 16 and 19 are started to operate in conformity with the alarm time.

Also in the second embodiment, the block diagram stays the same as FIG. 1 and therefore, an explanation will be given of the second embodiment in reference to FIG. 1 and FIG. 3 as follows.

First, by operating time setting means (not illustrated), there are set the hand operation stop time for stopping to operate the secondhand 16 and the hour/minute hand 19, the hand operation start time for starting to operate the second hand 16 and the hour/minute hand 19 and alarm generating time (step S201 of FIG. 3). The memory we stores the hand operation stop time and the hand operation start time of the time hands 16 and 19 and the alarm time.

Under the state, it is determined whether hand operation stopping means (not illustrated) is operated, that is, whether the forcible stop instruction is inputted from the input circuit 13 (step S202), when it is determined that the forcible stop instruction is inputted, the control circuit 12 processes to stop operating the time hands 16 and 19 and outputs the hand operation stop signal to the motor driver circuits 14 and 17 (step S208). The motor driver circuits 14 and 17 respectively stop rotating the motors 15 and 18 in response to the hand operation stop signal to thereby stop operating the time hands 16 and 19.

At step S202, when the hand operation stopping means has not been operated, that is, the forcible stop instruction has not been inputted from the input circuit 13, it is determined whether the hand operation stop time stored to the memory 23 has arrived (step S203), when it is determined that the hand operation stop time has arrived, the hand operation stop processing is carried out and the hand operation stop signal is inputted to the motor driver circuits 14 and 17 (step S208). The motor driver circuits 14 and 17 respectively stop rotating the motors 15 and 18 in response to the hand operation stop signal to thereby stop operating the hour hands 16 and 19.

At step S203, when it is determined that the hand operation stop time has not arrived, it is determined whether hand operation starting means (not illustrated) is operated, that is, whether the forcible hand operation start instruction is inputted (step S204), and when it is determined that the forcible hand operation start instruction is inputted from the input circuit 13, the hand operation start processing is carried out (step S209).

In the hand operation start processing at step S209, there is carried out a processing similar to that at step S107. That is, at step S209, the control circuit 12 outputs the fast feed signal generated by the dividing circuit 11 to the motor driver circuits 14 and 17. At the time point, the first counting means has already counted the drive amount (drive pulse number) necessary for driving the time hands 16 and 19 to the regular positions by counting the elapse time period since the motors 15 and 18 have been stopped, the second counting means counts the drive amount (drive pulse number) for fast feeding motors 16 and 19 by the fast feed signals and the motors are fast fed at the predetermined speeds or more until the drive amount counted by the first counting means and the drive amount counted by the second counting means coincide with each other (until current time). Thereafter, time indication is restarted by driving the motors 15 and 18 at the predetermined speeds by the second signal and the minute signal generated by the dividing circuit 11. Thereby, after restarting to operate the time hands 16 and 19, current time is indicated fastly, thereafter, the hands are driven to rotate at the predetermined speeds by normal hand operation control and time is indicated accurately.

At step S204, when it is determined that the forcible hand operation start instruction has not been inputted from the input circuit 103, it is determined whether the hand operation start time stored to the memory 23 has arrived (step S205) and when it is determined that the hand operation start time has arrived, the hand operation start processing is carried out (step S209).

Meanwhile, at step S205, when it is determined that the hand operation start time has not arrived, it is determined whether predetermined time (1 minute according to the embodiment) before alarm time stored to the memory 23 has been reached (step S206) and when it is determined that the predetermined time before the alarm time has been reached, the hand operation start processing is carried out (step S209). Further, the predetermined time is set to time capable of carrying out ordinary hand operation control after accurate current time is indicated by fast feeding the time hands 16 and 19 during a time period until the alarm time is reached after starting to operate the time hands 16 and 19. Thereby, when the alarm time has arrived and the alarm is generated, the ordinary hand operation has already been carried out.

After the processing at step S209 has been finished and when it is determined that the predetermined time before the alarm time stored to the memory 23 has not been reached at step S206, it is determined whether the alarm time stored to the memory 23 has arrived (step S207). When it is determined that the alarm time has arrived, by controlling the buzzer driver circuit 20, the alarm is generated by driving the buzzer 21 by the buzzer driver circuit 20 (step S210) and thereafter, the operation returns to step S202 and the above-described processings are repeated. Further, at step S207, when it is determined that the alarm time has not arrived, the alarm is not generated, the operation returns to step S202 and the above-described processings are repeated.

Further, step S201 constitutes the time setting means, step S202 constitutes the hand operation stop detecting means, S204 constitutes the hand operation start detecting means, steps S203 and S205 constitute time detecting means and steps S207 and S210 constitute alarming means.

As described above, also in the second embodiment, the hands are operated only when needed and therefore, at step S209, when the second hand 16 is driven to current time by driving to rotate the motor 15, the amount of rotating the second hand 16 becomes less than 60 seconds at maximum, further, the amount of rotating the time/minute hand 19 becomes less than 12 hours at maximum and therefore, power consumption can significantly be reduced. Further, in the case of driving to fast feed the second hand 16 and the hour/minute hand 19, when the hands are driven to rotate in directions in which hands reach current time faster, the power consumption can further be reduced.

Further, the hand operation is started at the predetermined time before the alarm time and therefore, when alarm of an alarm clock or the like is generated, the normal hand operation has been enabled to recover and the current time can be indicated.

Figure 4:
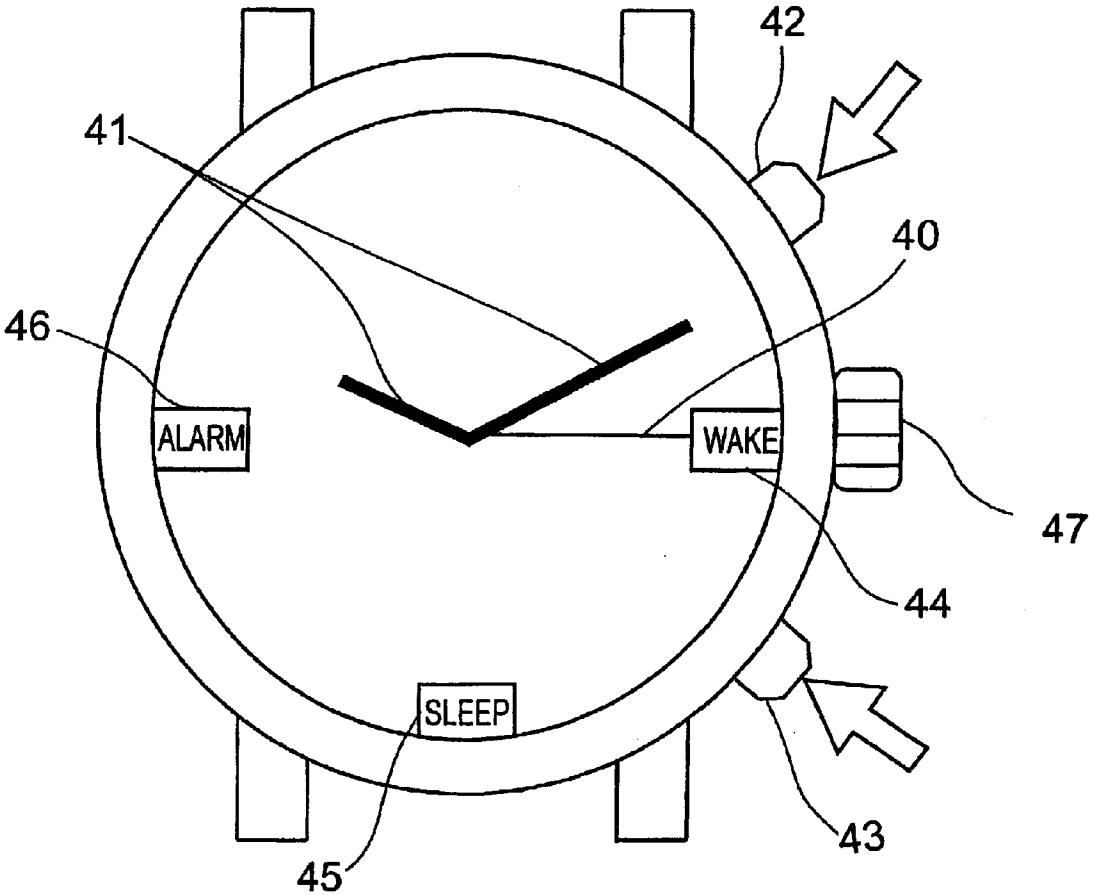
FIG. 4 is an outlook view of an electronic timepiece according to a third embodiment of the invention.

FIG. 4 is an outlook view of an electronic timepiece according to a third embodiment of the invention.

In FIG. 4, at a central portion of the electronic timepiece, a secondhand 40 and an hour/minute hand 41 are coaxially arranged. At a peripheral edge portion of a dial of the electronic timepiece, there are provided a hand operation start time setting mode indicating portion (WAKE) 44 indicating the hand operation start time setting mode at 3 o'clock position, a hand operation stop time setting mode indicating portion (SLEEP) 45 indicating the hand operation stop time setting mode at 6 o'clock position and an alarm time setting mode indicating portion (ALARM) 46 indicating the alarm time setting mode at 9 o'clock position. Further, at an outer peripheral edge portion of the electronic timepiece, there are provided a mode changeover switch 42, a time setting switch 43 and a crown 47. Here, the mode changeover switch 42, the time setting switch 43 and the crown 47 constitute time setting means, the mode changeover switch 42 and the crown 47 constitutes mode switching means and the time setting switch 43 constitutes hand operation time setting means. Further, the mode changeover switch 42 and the crown 47 constitute hand operation starting means and the time setting switch 43 and the crown 47 constitute hand operation stopping means. Further, although not illustrated, at inside of the electronic timepiece, there is provided a detecting switch constituting crown operation detecting means for detecting operation of the crown 47 and CPU 22 determines operation of the crown 47 by opening/closing the detection switch.

Further, also in the third embodiment, a circuit block diagram is constructed by a constitution the same as that of FIG. 1 and therefore, an explanation will be given in reference to FIG. 1 as necessary.

Figure 5:
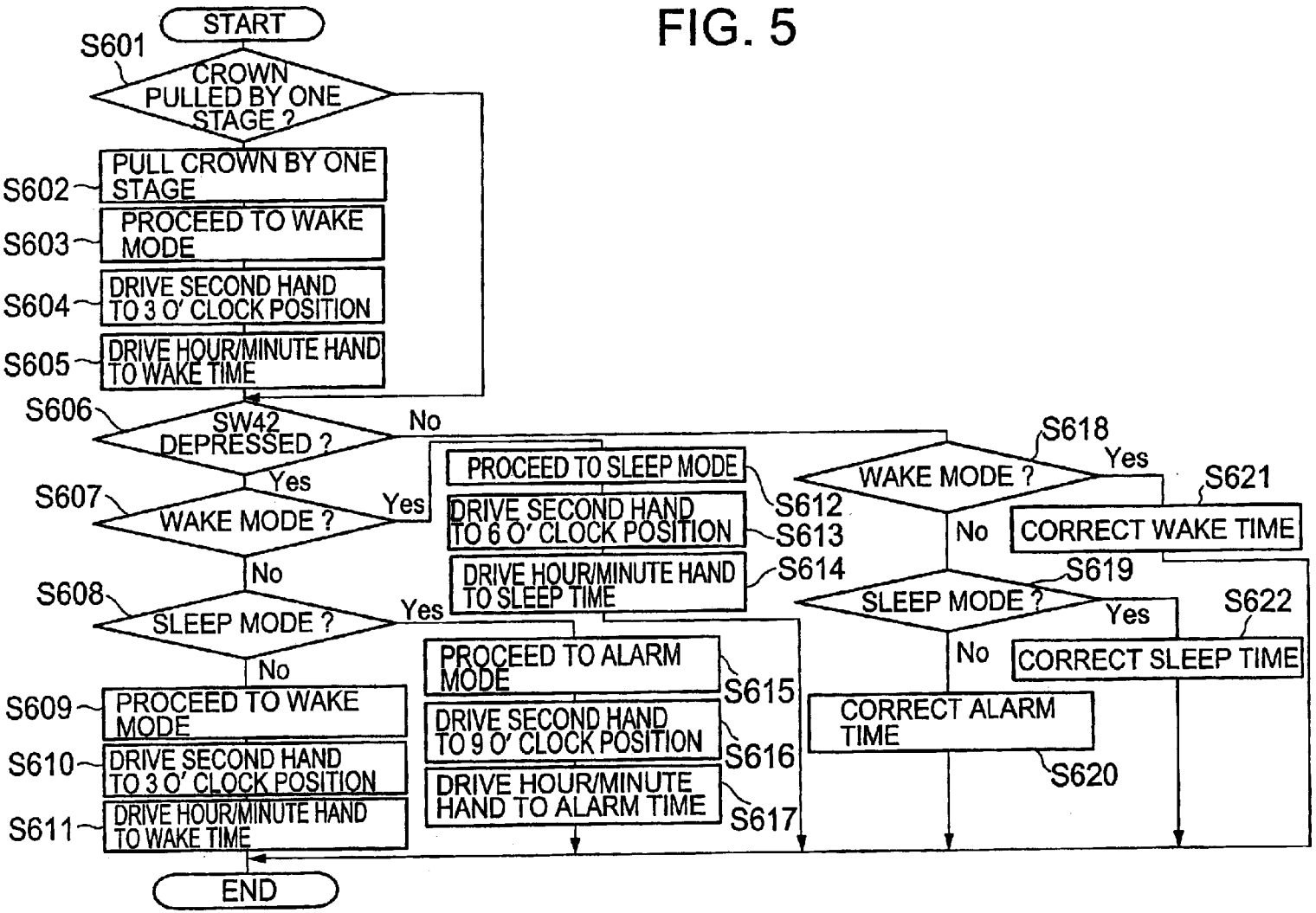
FIG. 5 is a flowchart showing a processing of the third embodiment of the invention.

FIG. 5 is a flowchart showing processings of CPU 22 according to the third embodiment and is a flowchart showing processings of setting and confirming the hand operation stop time, the hand operation start time and the alarm time and corresponds to the flowchart explaining, in details, step S201 according to the second embodiment.

Figure 6:
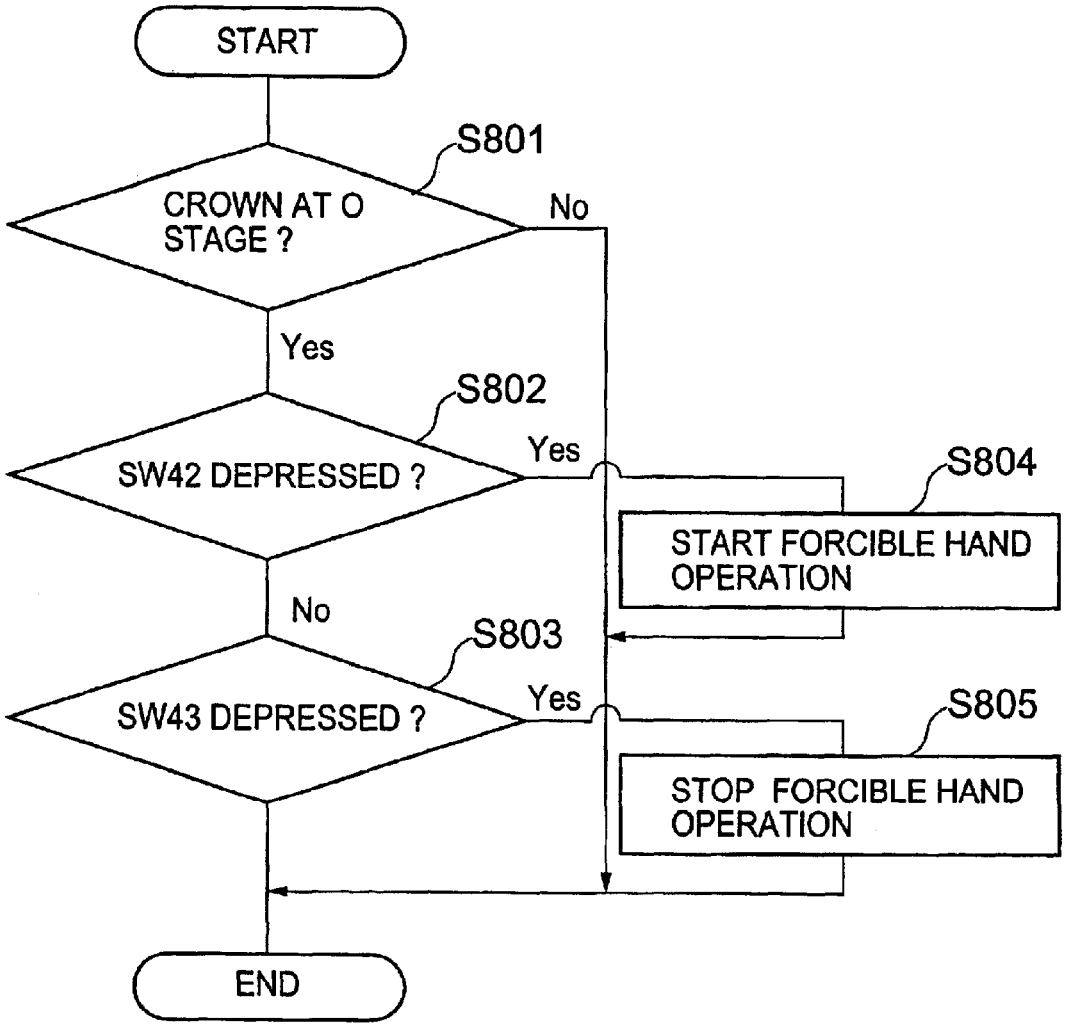
FIG. 6 is a flowchart showing a processing of the third embodiment of the invention.

Further, FIG. 6 is a flowchart showing processings of CPU 22 according to the third embodiment and is a flowchart showing processings of forcibly carrying out hand operation stopping and hand operation starting.

An explanation will be given of operation of the third embodiment in reference to FIG. 1, FIG. 5 and FIG. 6 as follows.

When the hand operation stop time, the hand operation start time and the alarm time are set or confirmed, in FIG. 5, first, it is determined whether the crown 47 is pulled by one stage (step S601). Whether the crown 47 is pulled by one stage, is detected by the crown operation detecting means. When it is determined that the crown 47 has already been pulled by one stage, the operation proceeds to step S606.

At step S601, when a user pulls the crown 47 by one stage after determining that the crown 47 has not been pulled by one stage yet, CPU 22 determines that the crown 47 has been pulled by one stage (step S602), the operation proceeds to the hand operation start time setting (WAKE) mode (step S603) and outputs a drive signal for moving the second hand 40 to the 3 o'clock (WAKE) position to the motor driver circuit 14 (step S604). The motor driver circuit 14 controls to rotate the motor 15 in response to the drive signal and drives the second hand 40 to the 3 o'clock (WAKE) position.

Further, CPU 22 reads the hand operation start time previously stored to the memory 23 and outputs a drive signal for setting the hour/minute hand 41 to the hand operation start time(step S605). The motor driver circuit 17 controls to rotate to fast feed the motor 18 in response to the drive signal to thereby make the hour/minute hand 41 indicate the hand operation start time. Thereby, it is indicated that the mode is the hand operation start time setting mode by the second hand 40 and the hand operation start time is indicated by the time/minute hand 41 and therefore, the user can easily confirm the hand operation start time already set.

Next, it is determined whether the mode changeover switch 42 has been operated to depress (step S606) and when it is determined that the mode changeover switch 42 has been operated to depress, it is determined whether the mode is the hand operation start time setting (Step S607). In Step S607, when it is determined that the mode is not the hand operation start time setting mode, it is determined whether the mode is the hand operation stop time setting (SLEEP) mode (step S608) and when it is determined that the mode is not the hand operation stop time setting mode, the operation proceeds to the hand operation start time setting mode (step S609) and outputs a drive signal for moving the second hand 40 to the 3 o'clock (WAKE) position to the motor drive circuit 14 (step S610). The motor driver circuit 14 controls to rotate the motor in response to the drive signal and drives the second hand 40 to the 3 o'clock (WAKE) position.

Further, CPU 22 reads the hand operation start time previously stored to the memory 23 and outputs a drive signal for setting the hour/minute hand 41 to the hand operation start time (step S611). The motor driver circuit 17 controls to rotate to fast feed the motor 18 in response to the drive signal to thereby make the hour/minute hand 41 indicate the hand operation start time. Thereby, it is indicated that the mode is the hand operation start time setting mode by the second hand 40, the hand operation start time is indicated by the hour/minute hand 41 and therefore, the user can easily confirm the hand operation start time.

At step S608, when it is determined that the mode is the hand operation stop time setting mode, the operation proceeds to the alarm time setting (ALARM) mode (step S615) and outputs a drive signal for moving the second hand 40 to the 9 o'clock (ALARM) position, to the motor driver circuit 14 (step S616). The motor driver circuit 14 drives the second hand 40 to the 9 o'clock alarm position by controlling to rotate the motor 15 in response to the drive signal.

Further, CPU 22 reads the alarm time previously stored to the memory 23 and outputs a drive signal for setting the hour/minute hand 41 to the alarm time (step S617). The motor driver circuit 17 controls to rotate to fast feed the motor 18 in response to the drive signal to thereby make the hour/minute hand 41 indicate the alarm time. Thereby, it is indicated that the mode is the alarm time setting mode by the second hand 40, further, the alarm time is indicated by the hour/minute hand 41 and therefore, the user can easily confirm the alarm time already set.

At step S607, when it is determined that the mode is the hand operation start time setting mode, the operation proceeds to the hand operation stop time setting mode (step S612) and outputs a drive signal for moving the second hand 40 to the 6 o'clock (SLEEP) position, to the motor driver circuit 14 (step S613). The motor driver circuit 14 controls to rotate the motor 15 in response to the drive signal and drives the second hand 40 to the 6 o'clock (SLEEP) position.

Further, CPU 22 reads the hand operation stop time previously stored to the memory 23 and outputs a drive signal for setting the hour/minute hand 41 to the hand operation stop time(step S614). The motor driver circuit 17 controls to rotate to fast feed the motor 18 in response to the drive signal and drives the hour/minute hand 41 to indicate the hand operation stop time. Thereby, it is indicated that the mode is the hand operation stop time setting mode by the second hand 40, further, the already set hand operation stop time is displayed by the hour/minute hand 41 and therefore, the user can easily confirm the hand operation stop time.

As described above, by operating the mode changeover switch 42 in the state of pulling the crown 47 by one stage, the mode is switched in an order of the hand operation start time setting mode→the hand operation stop time setting mode→the alarm time setting mode and already set time in the respective mode is indicated.

Meanwhile, at step S606, when it is determined that the mode changeover switch 42 is not operated to depress, it is determined whether the mode is the operation start time setting mode (step S618). When it is determined that the mode is the hand operation start time setting mode, the already set hand operation start time is corrected to new hand operation start time set by operating the time setting switch 43 and the new hand operation start time is stored to the memory 23 (step S621).

When the hand operation start time is stored to the memory 23 in this way, at step S605, the hour/minute hand 41 is driven to rotate to the stored hand operation start time. Further, at step S105 of FIG. 2 and step S205 of FIG. 3, the hand operation start processing can be carried out in reference to the hand operation start time stored to the memory 23 as described above.

At step S618, when it is determined that the mode is not the hand operation start time setting mode, it is determined whether the mode is the hand operation stop time setting mode (step S619) and when it is determined that the mode is the hand operation stop time setting mode, the already set hand operation stop time is corrected to new hand setting stop time set by operating the time setting switch 43 and the new hand setting stop time is stored to the memory 23 (step S622).

When the hand operation stop time is stored to the memory 23 in this way, at step S614, the hour/minute hand 41 is driven to rotate to the stored hand operation stop time. Further, at step S103 of FIG. 2 and step S203 of FIG. 3, the hand operation stop processing can be carried out in reference to the hand operation stop time stored to the memory 23 as described above.

At step S619, when it is determined that the mode is not the hand operation stop time setting mode, that is, when the mode is the alarm time setting mode, the already set alarm time is corrected to the new alarm time set by operating the time setting switch 43 and the new alarm time is stored to the memory 23 (step S623).

When the alarm time is stored to the memory 23 in this way, at step S617, the hour/minute hand 41 is driven to rotate until the stored alarm time. Further, in steps S206 and S207 of FIG. 3, the hand operation start processing (step S209) and the alarm generating processing (step S210) can be carried out in reference to the alarm time stored to the memory 23 as described above.

Further, steps S601 through S622 constitute time setting means.

Next, an explanation will be given of processings when the hand operation stopping and hand operation starting are forcibly carried out in reference to FIG. 6.

First, it is determined whether the crown 47 is pulled out (whether the crown 47 is at 0 stage) (step S801) and when it is determined that the crown 47 has been pulled out (when it is determined that the crown 47 is not at 0 stage), the processing is finished.

At step S801, when it is determined that the crown 47 is not pulled out (when it is determined that the crown 47 is at 0 stage), it is determined whether the mode changeover switch 42 has been operated to depress (step S802). When it is determined that the mode changeover switch 42 has been operated to depress, that is, when forcible hand operating instruction has been issued, the processing of the forcible hand operation starting is carried out and the above-described hand operation start processing is carried out to thereby finish the processing (step S804). By the hand operation start processing, the motors 15 and 18 for driving the time hands, fast feed the time hands 40 and 41 by a speed equal to or faster than the predetermined speed and thereafter, the normal hand operation control is carried out by the predetermined speed to thereby indicate time.

At step S802, when it is determined that the mode changeover switch 42 is not operated, that is, the forcible operation instruction is not issued, successively, it is determined whether the time setting switch 43 is operated to depress (step S803). When it is determined that the time setting switch 43 is not operated to depress, that is, when it is determined that forcible stop instruction is not issued, the processing is finished. When it is determined that the time setting switch 43 has been operated, that is, when it is determined that the forcible stop instruction has been issued, the hand operation stop processing is carried out and the motors 15 and 18 are made to stop driving to rotate to thereby finish the processing (step S808).

Further, steps S801 and S802 constitute the hand operation start detecting means and steps S801 and S803 constitute the hand operation stop detecting means.

Figure 7:
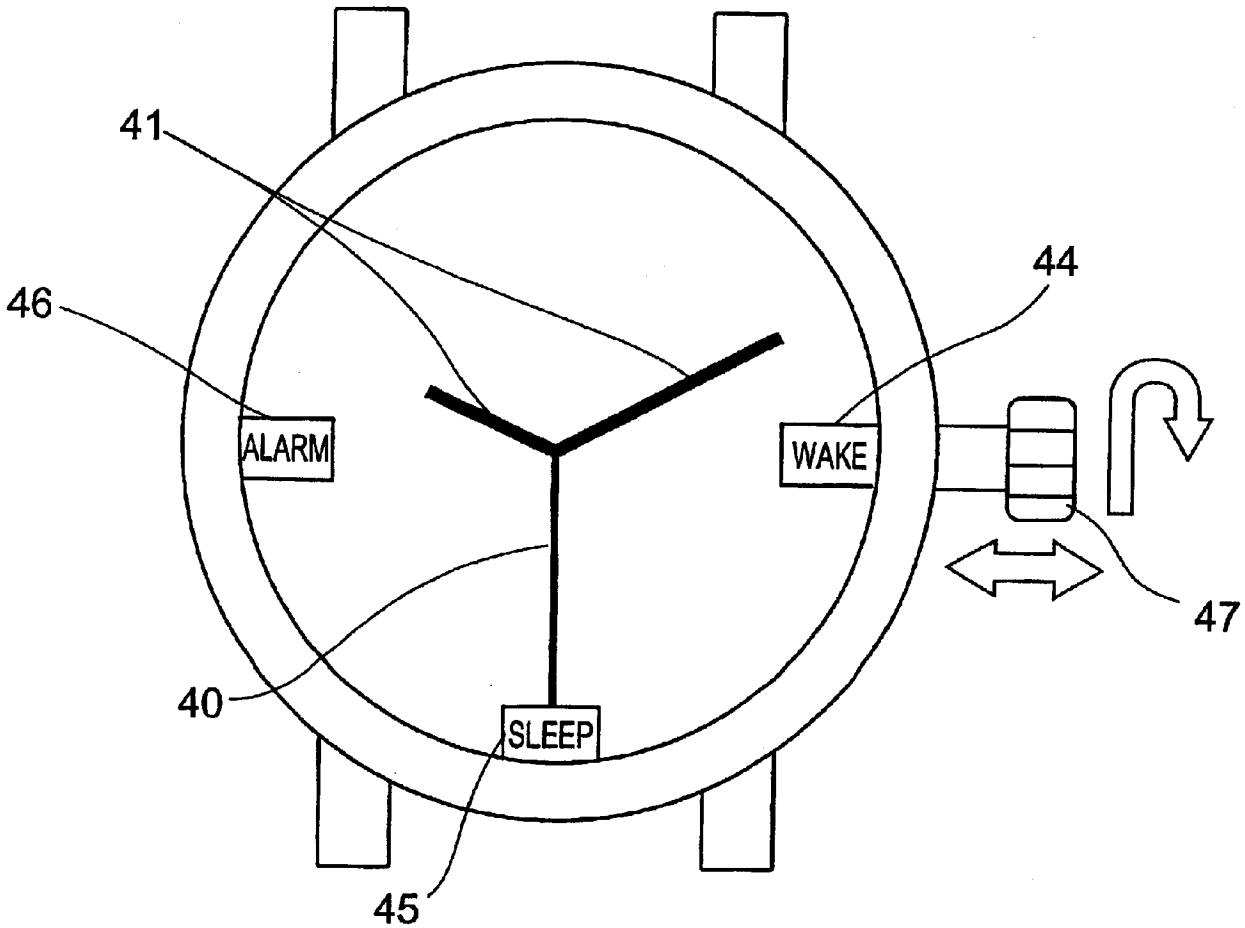
FIG. 7 is an outlook view of an electronic timepiece according to a fourth embodiment of the invention.

FIG. 7 is an outlook view of an electronic timepiece according to a fourth embodiment of the invention and portions thereof the same as those in FIG. 4 are attached with the same notations.

In FIG. 7, at a central portion of the electronic timepiece, the second hand 40 and the hour/minute hand 41 are coaxially arranged. At a peripheral edge portion of a dial of the electronic timepiece, there are provided the hand operation start mode indicating portion (WAKE) 44 indicating the hand operation start mode at 3 o'clock position, the hand operation stop mode indicating portion (SLEEP) 45 indicating the hand operation stop mode at 6 o'clock position and the alarm mode indicating portion (ALARM) 46 indicting the alarm mode at 9 o'clock position. Further, at an outer peripheral edge portion of the electronic timepiece, there is provided the crown 47 for switching the mode and setting the hand operation stop time, the hand operation start time and the alarm time. Further, although not illustrated, at inside of the electronic timepiece, for detecting operation of the crown 47, there is provided a detection switch for constituting the crown operation detecting means and CPU 22 determines operation of the crown 47 by opening/closing of the detection switch.

In this case, the crown 47 constitutes the time setting means, the mode switching means, the hand operation time setting means, the hand operation starting means and the hand operation stopping means.

Further, also in the fourth embodiment, a block diagram thereof is provided with a constitution the same as that of FIG. 1 and therefore, an explanation will be given in reference to FIG. 1 as necessary.

Figure 8:
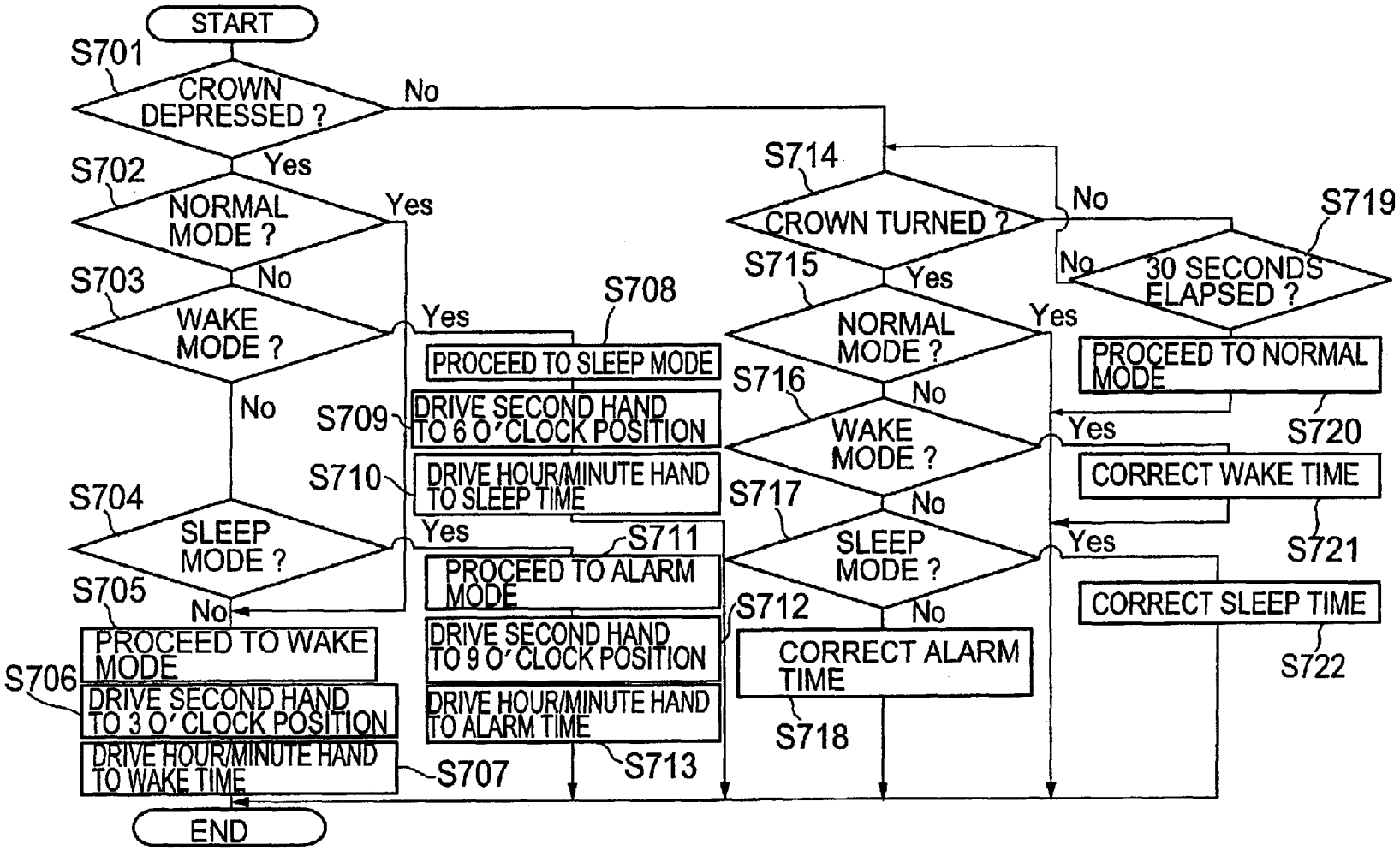
FIG. 8 is a flowchart showing a processing of the fourth embodiment of the invention.

FIG. 8 is a flowchart showing processings of CPU 22 according to the fourth embodiment and is a flowchart showing processings of setting the hand operation stop time, the hand operation start time and the alarm time.

Figure 9:
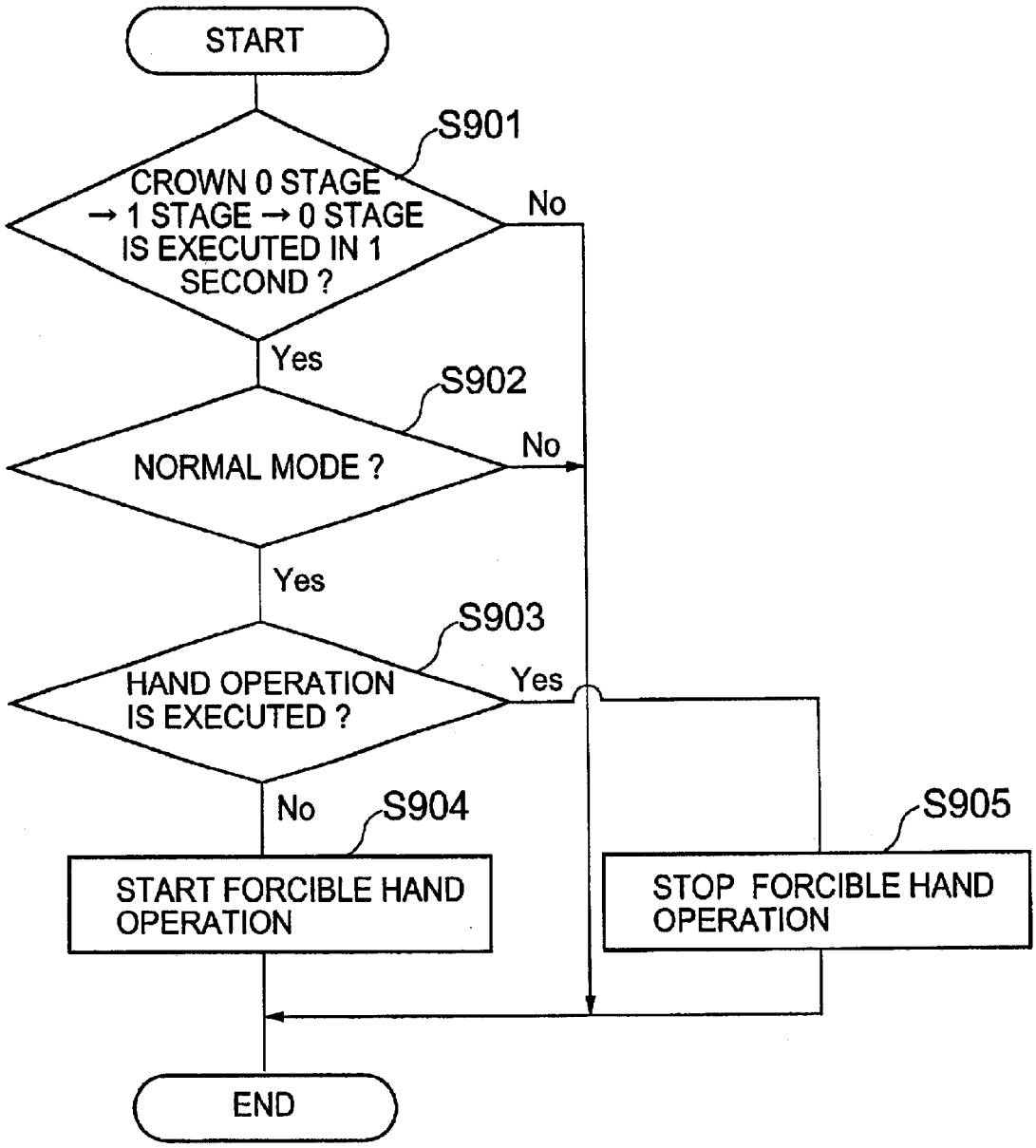
FIG. 9 is a flowchart showing a processing of the fourth embodiment of the invention.

Further, FIG. 9 is a flowchart showing processings of CPU 22 according to the fourth embodiment and is a flowchart showing processings of forcibly carrying out hand operation stopping and hand operation starting.

An explanation will be given of operation of the fourth embodiment in reference to FIG. 1, FIG. 8 and FIG. 9 as follows.

When the hand operation stop time, the hand operation start time and the alarm time are set, in FIG. 8, first, it is determined whether the crown 47 is operated to depress (step S701). Further, every time of operating to depress the crown 47, the operation is carried out to switch a normal mode (mode indicating time), the hand operation start time setting (WAKE) mode, the hand operation stop time setting (SLEEP) mode and the alarm time setting (ALARM) mode.

At step S701, when it is determined that the crown 47 has been operated, it is determined whether the mode is the normal mode for indicating time (S702). When it is determined that the mode is the normal mode, the operation proceeds to step S705.

At step S702, when it is determined that the mode is not the normal mode, it is determined whether the mode is the hand operation start time setting mode (step S703) and when it is determined that the mode is not the hand operation start time setting mode, it is determined whether the mode is the hand operation stop time setting mode (step S704). When it is determined that the mode is the hand operation stop time setting mode, the operation proceeds to the hand operation start time setting mode (step S705) and outputs a drive signal for moving the second hand 40 to 3 o'clock (WAKE), to the motor driver circuit 14 (step S706). The motor driver circuit 14 controls to rotate the motor 15 in response to the drive signal and drives the second hand 40 to the 3 o'clock (WAKE) position.

Further, CPU 22 reads the hand operation start time previously stored to the memory 23 and outputs a drive signal for setting the time/minute hand 41 to the hand operation start time(step S707). The motor driver circuit 17 controls to rotate to fast feed the motor 18 in response to the drive signal to thereby drive the hour/minute hand 41 to indicate the hand operation start time. Thereby, it is indicated that the mode is the hand operation start time setting mode by the second hand 40, further, the hand operation start time is indicated by the hour/minute hand 41 and therefore, the user can easily confirm the hand operation start time already set.

At step S704, when it is determined that the mode is the hand operation stop time setting mode, the operation proceeds to the alarm time setting mode (step S711) and outputs a drive signal for moving the secondhand 40 to 9 o'clock (ALARM) position, to the motor driver circuit 14 (step S712). The motor driver circuit 14 controls to rotate the motor 15 in response to the drive signal to thereby drive the second hand 40 to 9 o'clock (ALARM) position.

Further, CPU 22 reads the alarm time previously stored to the memory 23 and outputs a drive signal for setting the hour/minute hand 41 to the alarm time (step S713). The motor driver circuit 17 controls to rotate to fast feed the motor 18 in response to the drive signal to thereby drive the hour/minute hand 41 to indicate the alarm time. Thereby, it is indicated that the mode is the alarm time setting mode by the second hand 40, further, the alarm time is indicated by the hour/minute hand 41 and therefore, the user can easily confirm the alarm time already set.

At step S703, when it is determined that the mode is the hand setting start time setting mode, the operation proceeds to the hand setting stop time setting mode (step S708) and outputs a drive signal for moving the second hand 40 to 6 o'clock (SLEEP) position, to the motor driver circuit 14 (step S709). The motor driver circuit 14 controls to rotate the motor 15 in response to the drive signal to thereby drive the second hand 40 to 6 o'clock (SLEEP) position.

Further, CPU 22 reads the hand operation stop time previous stored to the memory 23 and outputs a drive signal for setting the hour/minute hand 41 to the hand operation stop time (step S710). The motor driver circuit 17 controls to rotate to fast feed the motor 18 in response to the drive signal to thereby make the hour/minute hand 41 indicate the hand operation stop time. Thereby, it is indicated that the mode is the hand operation stop time setting mode by the second hand 40, further, the hand operation stop time is indicated by the hour/minute hand 41 and therefore, the user can easily confirm the hand operation stop time already set.

Meanwhile, at step S701, when it is determined that the crown 47 is not operated to depress, it is determined whether the crown 47 is operated to rotate (step S714). When it is determined that the crown 47 has been operated to rotate, it is determined whether the mode is the normal mode (step S715).

When it is determined the mode is the normal mode, the processing is finished. When it is determined that the mode is not the normal mode, it is determined whether the mode is the hand operation start time setting mode (step S716), and when it is determined that the mode is the hand operation start time setting mode, new hand operation start time set by operating to rotate the crown 47, is stored to the memory 23 to thereby carry out a processing of correcting the hour hand start time and finish the processing (step S721).

When the hand operation start time is stored to the memory 23 in this way, at step S707, the hour/minute hand 41 is driven to rotate to the stored hand operation start time. Further, at step S105 of FIG. 2 and step S205 of FIG. 3, the hand operation start processing can be carried out in reference to the hand operation start time stored to the memory 23 as described above.

At step S716, when it is determined that the mode is not the hand operation start time setting mode, it is determined whether the mode is the hand operation stop time setting mode (step S717). When it is determined that the mode is the hand operation stop time setting mode, time set by operating to rotate the crown 47 is stored to the memory 23 as new hand operation stop time to thereby carry out a processing of correcting the hand setting stop time and finish the processing (step S722).

When the hand operation stop time is stored to the memory 23 in this way, at step S710, the hour/minute hand 41 is driven to rotate to the stored hand operation start time. Further, at step S103 of FIG. 2 and step S203 of FIG. 3, the hand operation stop processing is carried out in reference to the hand operation stop time stored to the memory 23 as described above.

At step S717, when it is determined that the mode is not the hand operation stop time setting mode, that is, when it is determined that the mode is the alarm time setting mode, time set by operating to rotate the crown 47 is stored to the memory 23 as the alarm time to thereby carry out a processing of correcting the alarm time and finish the processing (step S718).

When the new alarm time is stored to the memory 23 in this way, at step S713, the hour/minute hand 41 is driven to rotate to the stored alarm time. Further, at steps S206 and S207 of FIG. 3, the alarm generating processing can be carried out in reference to the alarm time stored to the memory 23 as described above.

Meanwhile, at step S714, when it is determined that the crown 47 is not operated to rotate, it is determined whether 30 seconds has elapsed (step S719). When it is determined that 30 seconds has not elapsed, the operation returns to step S714 and when it is determined that 30 seconds has elapsed, the operation proceeds to the normal mode to thereby finish the processing (step S720).

Further, steps S701 through S722 constitute time setting means.

Next, an explanation will be given of processings of forcibly carrying out hand operation stopping and hand operation starting.

First, it is determined whether predetermined operation is carried out at the crown 47, for example, whether pulling operation as well as depressing operation are carried out at the crown 47 in an order to 0 stage→1 stage→0 stage within 1 second (step S901), when it is determined that the predetermined operation is not carried out at the crown 47, the processing is finished.

At step S901, when it is determined that the above-described operation is carried out at the crown 47, it is determined whether the mode is the normal mode (step S902). When it is determined that the mode is not the normal mode, the processing is finished and when it is determined that the mode is the normal mode, it is determined whether the time hands 40 and 41 are operated (step S903). When it is determined that the hands are not operated, the above-described hand operation start processing is carried out forcibly (step S904) and when it is determined that the hands are operated, the above-described hand operation stop processing is carried out forcibly (step S905) to thereby finish the processing.

Further, steps S901 through S903 constitute hand operation start detecting means and hand operation stop detecting means.

As described above, according to the embodiments of the invention, there is provided an electronic timepiece characterized in particularly comprising a motor for driving to rotate a time hand, time setting means for setting hand operation stop time and hand operation start time of the time hand, storing means for storing the hand operation stop time and the hand operation start time set by the hand operation time setting means, first counting means for counting a drive amount necessary for driving the time hand to a regular position by counting an elapse time period since the motor has been stopped, second counting means for counting a drive amount of fast feeding the motor, time detecting means for detecting arrival of time set to the storing means, and controlling means for controlling rotation of the motor, wherein the controlling means stops the rotation of the motor when the time detecting means detects arrival of the hand operation stop time and restarts time indication by fast feeding the motor at a predetermined speed or more until the drive amount counted by the first counting means and the drive amount counted by the second counting means coincide with each other when the time detecting means detects arrival of the hand operation start time after stopping the motor and driving the motor at the predetermined speed.

Further, there is provided the electronic timepiece characterized in further comprising alarming means for setting alarm time to the storing means and generating alarm when the alarm time arrives at the time setting means, wherein the controlling means restarts the time indication by fast feeding the motor at the predetermined speed or more until the drive amount counted by the first counting means and the drive amount counted by the second counting means coincide with each other when the time detecting means detects a predetermined time period before the alarm time after stopping the motor and thereafter driving the motor at the predetermined speed.

Therefore, by operating the hands only when needed, power consumption can be reduced.

Further, a battery can be provided with a long service life, a small capacity of a battery can be mounted and therefore, an electronic timepiece can be downsized.

Further, by interlocking with alarm, time hands are recovered to current time at wake up time and therefore, the current time can immediately be confirmed.

Further, although according to the embodiments, an explanation has been given of an example of an analog electronic wrist watch, the invention is applicable to various electronic timepieces of a clock timepiece and the like.

According to the invention, by operating hands only when needed, power consumption can be reduced.

What is claimed is:

1. An electronic timepiece comprising:

a motor for driving to rotate a time hand;

a time setting circuit for setting hand operation stop time and hand operation start time of the time hand;

a storing circuit for storing the hand operation stop time and the hand operation start time set by the hand operation time setting circuit;

a first counting circuit for counting a drive amount necessary for driving the time hand to a regular position by counting an elapse time period since the motor has been stopped;

a second counting circuit for counting a drive amount of fast feeding the motor;

a time detecting circuit for detecting arrival of time set to the storing circuit; and a controlling circuit for controlling rotation of the motor;

wherein the controlling circuit stops the rotation of the motor when the time detecting circuit detects arrival of the hand operation stop time and restarts time indication by fast feeding the motor at a predetermined speed or more until the drive amount counted by the first counting circuit and the drive amount counted by the second counting circuit coincide with each other when the time detecting circuit detects arrival of the hand operation start time after stopping the motor and driving the motor at the predetermined speed.

2. The electronic timepiece according to claim 1, further comprising a hand operation stopping circuit for forcibly stopping to operate the time hand and a hand operation stop detecting circuit for detecting operation of the hand operation stopping circuit;

wherein the controlling circuit stops the rotation of the motor when the hand operation stop detecting circuit detects the operation of the hand operation stopping circuit.

3. The electronic timepiece according to claim 1, further comprising a hand operation starting circuit for forcibly starting to operate the time hand and a hand operation start detecting circuit for detecting operation of the hand operation starting circuit;

wherein the controlling circuit restarts the time indication by fast feeding the motor at the predetermined speed or more until the drive amount counted by the first counting circuit and the drive amount counted by the second counting circuit coincide with each other when the hand operation start detecting circuit detects the operation of the hand operation starting circuit after stopping the motor and thereafter driving the motor at the predetermined speed.

4. The electronic timepiece according to claim 1, further comprising an alarming circuit for setting alarm time to the storing circuit and generating alarm when the alarm time arrives at the time setting circuit;

wherein the controlling circuit restarts the time indication by fast feeding the motor at the predetermined speed or more until the drive amount counted by the first counting circuit and the drive amount counted by the second counting circuit coincide with each other when the time detecting circuit detects a predetermined time period before the alarm time after stopping the motor and thereafter driving the motor at the predetermined speed.

5. The electronic timepiece according to claim 1, wherein the time hand is constituted by an hour hand, a minute hand and a second hand and the motor is constituted by a first motor for driving the second hand and a second motor for driving the hour hand and the minute hand.

6. The electronic timepiece according to claim 5, further comprising a mode switch for switching a hand operation stop time setting mode for setting the hand operation stop time and a hand operation start time setting mode for setting the hand operation start time and hand operation time setting circuit for setting the hand operation stop time by the hand operation stop time setting mode and setting the hand operation start time by the hand operation start time setting mode at the time setting circuit;

wherein the controlling circuit controls the first motor to move the second hand selectively to indicating positions of the hand operation stop time setting mode and the hand operation start time setting mode in response to mode switching by the mode switch.

7. The electronic timepiece according to claim 6, wherein the mode switch switches the mode further to an alarm time setting mode for setting alarm time and the hand operation time setting circuit sets the alarm time by the alarm time setting mode;

wherein the controlling circuit moves the second hand selectively to indicating positions of the hand operation stop time setting mode, the hand operation start time setting mode and the alarm time setting mode in response to the mode switching by the mode switch.

8. The electronic timepiece according to claim 6 further comprising crown operation detecting circuit for detecting operation of a crown at the mode switch for carrying out the mode switching in accordance with the operation of the crown detected by the crown operation detecting circuit.

* * * * *